US012203656B2

(12) United States Patent
Kasuga et al.

(10) Patent No.: US 12,203,656 B2
(45) Date of Patent: Jan. 21, 2025

(54) COMBUSTION NOZZLE AND COMBUSTOR

(71) Applicant: TOYOTA JIDOSHA KABUSHIKI KAISHA, Toyota (JP)

(72) Inventors: Shunsuke Kasuga, Numazu (JP); Yasushi Tatebayashi, Fuji (JP); Shigeru Hirano, Mishima (JP); Takahiro Minami, Sunto-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/498,387

(22) Filed: Oct. 31, 2023

(65) Prior Publication Data

US 2024/0183537 A1 Jun. 6, 2024

(30) Foreign Application Priority Data

Dec. 2, 2022 (JP) ..... JP2022-193746

(51) Int. Cl.
*F23R 3/14* (2006.01)
*F23D 11/38* (2006.01)
*F23R 3/28* (2006.01)

(52) U.S. Cl.
CPC ..... *F23R 3/14* (2013.01); *F23D 11/383* (2013.01); *F23R 3/286* (2013.01)

(58) Field of Classification Search
CPC ..... F23D 11/383; F23D 2900/14021; F23D 2900/14701; F23R 3/286
See application file for complete search history.

(56) References Cited

U.S. PATENT DOCUMENTS 3,912,164 A * 10/1975 Lefebvre ..... F23R 3/14 239/406
4,845,952 A 7/1989 Beebe
5,489,203 A * 2/1996 Dobbeling ..... F23D 11/40 431/284
2006/0096296 A1 5/2006 Held et al.
2010/0050644 A1 3/2010 Pidcock et al.
2010/0083663 A1 4/2010 Fernandes et al.
2012/0234013 A1* 9/2012 Overman ..... F23R 3/283 60/746

(Continued)

FOREIGN PATENT DOCUMENTS

JP 2003-148734 A 5/2003
JP 2016-109309 A 6/2016

(Continued)

*Primary Examiner* — Scott J Walthour
(74) *Attorney, Agent, or Firm* — Oliff PLC

(57) ABSTRACT

A combustion nozzle discharges compressed air and fuel, to be combusted, into a combustion chamber of a combustor of a gas turbine. The combustion nozzle includes an air inlet, a nozzle orifice, an air channel, a fuel channel, and fuel outlets. The air inlet receives the compressed air. The nozzle orifice opens into the combustion chamber and discharges the compressed air. The air channel communicates between the air inlet and the nozzle orifice. The fuel channel receives the fuel, and discharges the fuel from the fuel outlets toward a flow of the compressed air discharged from the nozzle orifice. The air channel includes a Venturi section in which a channel cross-sectional area of the compressed air becomes relatively small. The fuel outlets are provided in the Venturi section.

15 Claims, 8 Drawing Sheets

(56) References Cited

U.S. PATENT DOCUMENTS

| | | | | |
|---|---|---|---|---|
| 2013/0192591 | A1* | 8/2013 | Satoh | F23C 3/00<br>126/92 AC |
| 2016/0363320 | A1* | 12/2016 | Benjamin | F02C 7/22 |
| 2017/0307210 | A1 | 10/2017 | Hirano et al. | |
| 2023/0366551 | A1* | 11/2023 | Vukanti | F23D 14/24 |

FOREIGN PATENT DOCUMENTS

| | | | |
|---|---|---|---|
| JP | 2020-106258 | A | 7/2020 |
| WO | 03/072919 | A1 | 9/2003 |

* cited by examiner

COMBUSTION NOZZLE AND COMBUSTOR

CROSS-REFERENCE TO RELATED APPLICATION

This application claims priority to Japanese Patent Application No. 2022-193746 filed on Dec. 2, 2022, incorporated herein by reference in its entirety.

BACKGROUND

1. Technical Field

The present disclosure relates to a combustor of a gas turbine engine (hereinafter referred to as "gas turbine"), and a nozzle (combustion nozzle) for discharging compressed air and fuel into a combustion chamber for combustion thereof in the combustor, and the combustor, and more specifically relates to a combustor that is suitable for a gas turbine capable of using hydrogen as fuel (hydrogen gas turbine) and a combustion nozzle thereof.

2. Description of Related Art

Research and development of heat engines such as gas turbines and so forth that use hydrogen as fuel is being advanced from the perspective of suppressing global warming and promoting decarbonization. For example, Japanese Unexamined Patent Application Publication No. 2016-109309 (JP 2016-109309 A) proposes a combustor for a gas turbine that uses hydrogen and methane as fuel. A combustion field is formed by injecting methane, which is the main fuel, from a premix fuel combustion main burner disposed on an upstream side of a combustion cylinder that makes up a combustion chamber. A plurality of diffusion combustion type reheating burners for injecting fuel from a peripheral wall into the combustion chamber is installed in the combustion field, and hydrogen is introduced from a part thereof. According to this configuration, the main burner is a premix fuel combustion type burner, and accordingly the amount of nitrogen oxides (NOx) in high-temperature combustion gas generated in a primary combustion region on the upstream side of the combustion chamber is suppressed. Also, the distributed layout of the reheating burners for introducing hydrogen enables fuel concentration in each combustion area of each reheating burner to be leaner, the combustion temperature of each reheating burner is suppressed overall, and the generation of NOx can be suppressed. Further, in this configuration, adopting diffusion combustion type reheating burners reduces the risk of backfire. Japanese Unexamined Patent Application Publication No. 2020-106258 (JP 2020-106258 A) proposes a gas turbine that utilizes a highly reactive gas such as hydrogen as fuel. A plurality of annular fuel injection units is disposed concentrically on an upstream end face of the combustion cylinder that makes up the combustion chamber, for a combustor structure that realizes low-NOx combustion and backfire prevention, and suppresses combustion dynamics. Each fuel injection unit has an annular fuel injection member having a plurality of fuel injection holes opening on an outer circumferential face and/or an inner peripheral face, and an annular air guide member that guides air with respect to the fuel gas injected from the fuel injection holes of the annular fuel injection member. Out of a plurality of circumferential-direction separating walls that extend radially and circumferentially separate gas passages of the annular fuel injection units at equal intervals, and radial-direction separating walls that extend circumferentially and separate two adjacent annular fuel injection units in the radial direction, at least one type of separating wall is provided. Further, Japanese Unexamined Patent Application Publication No. 2003-148734 (JP 2003-148734 A) proposes gas turbine equipment. Fuel and air are delivered to the combustion chamber as a plurality of concentric jets, in order to reduce NOx emissions and to promote mixture of fuel and air, so as to improve flame stability in the combustion chamber. An air flow is formed on an outer circumferential side of a fuel flow within a premix fuel channel, around the fuel flow at the center. In such a configuration, premixing enables fuel to be leaner, whereby low NOx can be advantageously realized. However, a large space is required to create a good mixture state, and as a tradeoff, the risk of backfire in which reverse flow of fuel occurs can increase. Accordingly, a configuration in which a plurality of nozzles is provided enables the fuel to be burned in a narrow space in a short time, and backfire to be suppressed. Although the configuration described in this literature does not limit the fuel to hydrogen, this is the basic structure of structures related to hydrogen combustion that will be described below.

There is expectation for further widespread use of gas turbines that use hydrogen as fuel (hydrogen gas turbines), which do not emit $CO_2$. For this purpose, it is advantageous to downsize gas turbines so as to be capable of installation in vehicles such as automobiles or the like.

A point to note when using hydrogen as fuel for gas turbines is that hydrogen has a higher combustion temperature than hydrocarbon fuels commonly used heretofore. In order to suppress generation of NOx, mixing the fuel and air sufficiently and uniformly before combustion, so as not to create a region in which the fuel concentration is locally high and the combustion temperature will become high, and to rarefy the overall fuel concentration to keep the combustion temperature low, are necessary (even more so than in the case of conventional hydrocarbon fuels). Also, hydrogen has a higher combustion speed than hydrocarbon fuels. The quenching distance of hydrogen (0.64 mm) is shorter than that of hydrocarbon fuels (around 2 mm). In order to suppress backfire from occurring, in which reverse flow of combustion in the fuel channel occurs, a configuration that is different from when using conventional hydrocarbon fuel becomes necessary in the portion where fuel is injected into the combustion chamber.

With regard to this point, configurations of conventionally-known combustors for a gas turbines that can use hydrogen as fuel are intended for medium- or large-sized power generation engines and annular combustors that generate more than 1 megawatt (MW) of power, and application to small-sized engines or annular combustors such as those that generate around 1 MW of power is difficult. For example, in the case of a micromix combustor (e.g., JP 2020-106258 A) or a multi-cluster combustor, which are known as conventional combustor configurations for gas turbines that can use hydrogen as fuel, hydrogen is sprayed at a plurality of locations, and flames are distributed and laid out so as to be as small as possible. This suppresses the fuel concentration from becoming locally high, and also the fuel in the combustion field is in a rare state, thereby suppressing the increase in combustion temperature. Thus, suppression of generation of NOx is accomplished. In this case, the structure is complicated and the number of parts is great, requiring a large space. It is difficult to realize a downsized configuration of such a combustor. Also, when the supply port of hydrogen to the combustion chamber is reduced in order to circumvent backfire of hydrogen that has a short quenching distance, as seen in the conventional structure (JP 2020-106258 A, etc.), it is difficult to mix air and hydrogen sufficiently and uniformly in a small space before combustion, in a configuration in which air and hydrogen merge in the vicinity of the hydrogen supply port. This requires a large space. Accordingly, in order to appropriately suppress generation of NOx while circumventing backfire in small-sized gas turbines that can use hydrogen as fuel, a combustion nozzle with a novel structure that is capable of mixing air and hydrogen sufficiently and uniformly in a small space before combustion, and achieving combustion in a rare fuel state, would be advantageous.

SUMMARY

The present disclosure provides a combustion nozzle with a novel structure that is suitable for combustors of small-sized gas turbines capable of using hydrogen as fuel.

The present disclosure also provides a combustion nozzle that can be used in the combustors of small-sized gas turbines such as described above, with a novel structure that is capable of sufficiently mixing air and hydrogen uniformly in a small space before combustion while circumventing backfire, and achieving combustion in a rare fuel state.

Further, the present disclosure provides a gas turbine combustor provided with the combustion nozzle as described above.

One aspect of the present disclosure is a combustion nozzle for discharging compressed air and fuel, to be combusted, into a combustion chamber of a combustor of a gas turbine. The combustion nozzle includes an air inlet configured to receive the compressed air, a nozzle orifice that opens into the combustion chamber and that is configured to discharge the compressed air, an air channel communicating between the air inlet and the nozzle orifice, a fuel channel for receiving the fuel, and one or more fuel outlets. The fuel channel is configured to discharge the fuel from the fuel outlets toward a flow of the compressed air discharged from the nozzle orifice. The air channel includes a Venturi section in which a channel cross-sectional area of the compressed air becomes relatively small. The fuel outlets are provided in the Venturi section.

In the above configuration, the "combustion nozzle" is a nozzle that mixes and discharges the compressed air and the fuel to be combusted into the combustion chamber in the combustor of the gas turbine, as described above. Here, the "air channel" is a channel for passage of air that is defined between the "air inlet" for receiving the compressed air, and the "nozzle orifice" that opens into the combustion chamber. The "fuel channel" is a channel that receives fuel and performs passage thereof to the "fuel outlet". The "Venturi section" is a section in which the "channel cross-sectional area" (cross-sectional area of a region through which fluid can flow) is narrowed to be relatively smaller than upstream and downstream of this section, in the air channel that communicates between the air inlet and the nozzle orifice. The fuel outlet, which is an outlet of the fuel channel, opens into the Venturi section in the air channel, and is provided so as to discharge fuel toward the flow of compressed air flowing therethrough. The fuel may be hydrogen.

According to the above-described configuration of the combustion nozzle of the present disclosure, when the compressed air enters the air channel from the air inlet and is delivered from the nozzle orifice, flow velocity of a flow of the compressed air becomes high at the time of passing through the Venturi section, in which the channel cross-sectional area is reduced. At this point in time, the fuel is delivered into the flow of compressed air. Thus, the fuel is dispersed in the flow of compressed air in a state in which the flow velocity thereof is higher. This enables the fuel to be mixed more uniformly and thoroughly with the compressed air than when the fuel is simply merged with the flow of compressed air. Occurrence of areas where the fuel concentration is locally high is suppressed. When the flow of compressed air in which the fuel is dispersed flows out from the nozzle orifice into the combustion chamber after passing through the Venturi section, a broader space is encountered. Overall fuel concentration is reduced. Also, the fuel is delivered when the flow velocity of the compressed air is increased, and accordingly backfire into the fuel channel can be circumvented, even when the fuel is hydrogen that has a high combustion velocity. Thus, according to the above-described configuration of the present disclosure, a state in which the compressed air and the fuel are sufficiently mixed and the fuel is rare in the combustion field can be realized while circumventing backfire, in a relatively short distance over which the compressed air passes through the nozzle, i.e., in a relatively small space. Accordingly, combustion temperature does not become excessively high, and the amount of NOx generated can be suppressed. Note that how small the cross-sectional area of the channel in the Venturi section is to be narrowed, relative to the cross-sectional area of the channel upstream and downstream of this section, may be determined in accordance with suitability. In particular, when the fuel is hydrogen, the density thereof is markedly low as compared to hydrocarbon fuel, and the inertial force is small (momentum is weak) when discharged from the fuel outlets. Accordingly, in the above configuration, the fuel outlets may be disposed substantially equidistantly along a circumferential direction of the air channel, such that the fuel is uniformly dispersed in the flow of compressed air even more surely. The number of the fuel outlets may be determined in accordance with suitability. Furthermore, in order to more surely circumvent backfire from the combustion chamber to the fuel outlets, the fuel outlets may have an inner diameter (hole diameter) that is smaller than the quenching distance of the fuel. Specifically, when the fuel is hydrogen, the quenching distance is approximately 0.64 mm, and accordingly the diameter of the fuel outlets may be, for example, 0.6 mm or smaller.

In the above configuration, the Venturi section of the air channel may include a first region in which the channel cross-sectional area gradually decreases from an upstream side of the Venturi section along a direction of flow of the compressed air, and a second region in which the channel cross-sectional area gradually increases from a downstream end of the first region toward the nozzle orifice. According to this configuration, the channel cross-sectional area of the flow of compressed air is smoothly and continuously constricted and then smoothly expanded. The flow of compressed air flows over the air channel while smoothly changing flow velocity, with almost no stagnation. Hardly any areas where the fuel concentration is locally high are generated, and the fuel is dispersed more uniformly. The combustion temperature is expected to become more uniformly distributed in the combustion field. In such a configuration, the fuel channel may extend through a peripheral wall defining the air channel, and the fuel outlets may open on an inner-side surface of the peripheral wall in the second region of the Venturi section, in which the cross-sectional area gradually increases. Alternatively, the fuel outlets may open on the inner-side surface of the peripheral wall at the vicinity of the downstream end of the first region of the Venturi section (upstream end of the second region), i.e., at or in the vicinity of the portion where the channel cross-sectional area is the smallest in the Venturi section. According to this configuration, it is expected that the fuel will be discharged to where the flow velocity of the flow of compressed air is high, and that the fuel will be dispersed more uniformly. Note that specific positions of the fuel outlets may be determined in accordance with suitability.

In the above configuration, a swirler may be provided on an upstream side of the Venturi section of the air channel, to change the flow of compressed air in accordance with an optional method into a swirling flow, in order to more uniformly disperse the fuel in the flow of compressed air. The flow of compressed air becomes the swirling flow and passes through the Venturi section at which the fuel is delivered, whereby the fuel is better dispersed in the air flow during the short travel distance of the air flow. For example, such a swirler may have a center cone disposed following a center axis along a direction of flow of the compressed air of the air channel, and a vane-like member extending in a radial direction from the center cone and having a surface inclined with respect to the center axis of the air channel. The flow of the compressed air flows along the surface of the vane-like member (which may have a shape like that of a screw propeller that does not rotate) to create the swirling flow. In the swirler with such a configuration, when an outer diameter of the center cone through which air does not flow is too large with respect to an inner diameter of the air channel, the flow velocity on an extension line of the center cone will decrease, and the likelihood of reverse flow of flames from the combustion field to the center cone occurring will increase. Accordingly, a ratio of an outer diameter of the center cone of the swirler, as to an inner diameter of a portion at which the swirler is installed in the air channel, may be below a predetermined value that is adjusted such that the flow velocity on the extension line of the center cone does not become excessively slow. Alternatively, the ratio of the outer diameter of the center cone of the swirler, as to the inner diameter of the portion at which the swirler is installed in the air channel, may be sufficiently large to circumvent reverse flow of fluid from the combustion chamber into the air channel. According to this configuration, melting damage of a distal end of the center cone due to flames is suppressed.

Further, as a configuration for circumventing melting damage of the distal end of the center cone of the swirler due to flames even more surely, the combustion nozzle may include a center-cone-interior channel having a fluid outlet. The center-cone-interior channel passes through the center cone of the swirler along the center axis following the direction of flow of compressed air in the air channel. The fluid outlet opens at the distal end of the center cone on the downstream side of the flow of compressed air. The compressed air is passed through the center-cone-interior channel, and the compressed air is discharged from the fluid outlet toward the combustion chamber. According to such a configuration, flames are suppressed from reaching the distal end of the center cone, due to the air flow being discharged from the distal end of the center cone as well. Melting damage of the distal end of the center cone is suppressed even more surely.

Note that in the swirler configuration described above, the center cone may extend so that the distal end on the downstream side of the flow of compressed air is located in the section of the first region in which the channel cross-sectional area of the Venturi section of the air channel gradually decreases. The distal end on the downstream side of the flow of compressed air may extend to the second region in which the channel cross-sectional area of the Venturi section of the air channel gradually increases. In the case of the former, the distal end of the center cone is disposed at a distance from the combustion field, whereby melting damage of the distal end of the center cone is circumvented. In the case of the latter, the flow velocity of the air flow around the distal end of the center cone increases, and reverse flow of the combustion fluid to the distal end of the center cone is circumvented.

As yet another form, the combustion nozzle may include a center-cone-interior channel having a fluid outlet. The center-cone-interior channel passes through the center cone of the swirler along the center axis following the direction of flow of compressed air in the air channel. The fluid outlet opens at the distal end of the center cone on the downstream side of the flow of compressed air. The fuel is passed through the center-cone-interior channel and the fuel is discharged from the fluid outlet toward the combustion chamber. According to this configuration, the fuel is expected to be mixed better with the compressed air flow in the vicinity of the nozzle orifice.

Alternatively or additionally, further flow paths for air (peripheral-edge air flow paths) may extend passing through the peripheral wall defining the air channel. Air outlets are provided on the inner-side surface of the peripheral wall in the second region of the Venturi section, or in the inner-side surface of the peripheral wall in the vicinity of the downstream end of the first region of the Venturi section. The flows of compressed air flowing through the peripheral-edge air flow paths are delivered from the air outlets to the flow of compressed air passing through the air channel. According to this configuration, the air and the fuel are mixed better in the air-fuel mixture of the compressed air and the fuel sent to the combustion chamber. Uneven combustion density is suppressed from occurring. Further suppression in the amount of NOx generated is expected. Note that the discharge direction of the fluid from the air outlets and the fuel outlets may be inclined in optional directions with respect to the radial direction from the center axis of the air channel. Thus, even better mixing of the air and the fuel is expected.

In a combustor of a gas turbine provided with a combustion nozzle as described above, a state in which compressed air and fuel are sufficiently mixed, and the fuel is rare in a combustion field, can be realized in a combustion chamber. Accordingly, as described above, the combustion temperature does not become excessively high, and the amount of NOx generated can be suppressed. Another aspect of the present disclosure is a combustor of a gas turbine, the combustor including a combustion nozzle for discharging compressed air and fuel, to be combusted, into a combustion chamber. The combustion nozzle includes an air inlet configured to receive the compressed air, a nozzle orifice that opens into the combustion chamber and that is configured to discharge the compressed air, an air channel communicating between the air inlet and the nozzle orifice, a fuel channel for receiving the fuel, and a fuel outlet. The fuel channel is configured to discharge the fuel from the fuel outlet toward a flow of the compressed air discharged from the nozzle orifice. The air channel includes a Venturi section in which a channel cross-sectional area of the compressed air becomes relatively small. The fuel outlet is provided in the Venturi section. In the combustor of the present disclosure, the combustion nozzles may have various characteristic configurations as described above. Such cases also are encompassed by the scope of the present disclosure.

Thus, the combustion nozzle of the combustor of the gas turbine according to the present disclosure described above is capable of achieving sufficiently uniform mixing of the fuel with the flow of compressed air and rarefication of fuel concentration over a relatively short distance, when delivering the flow of compressed air and fuel into the combustion chamber. This combustion nozzle can be used as a combustion nozzle for a combustor of a small-sized gas turbine in which backfire is circumvented and the amount of NOx generated is suppressed, even when a fuel such as hydrogen with a high combustion temperature is used. The combustion nozzle and the combustor equipped therewith according to the present disclosure can be used in gas turbines that use hydrogen as fuel, which are downsized so as to be installable in vehicles such as automobiles and so forth. Thus, hydrogen gas turbines are anticipated to come into more widespread use.

Other objects and advantages of the present disclosure will become apparent from the following description of preferred embodiments of the present disclosure.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Basic Configuration of Combustor and Combustion Nozzle

Figure 1A:
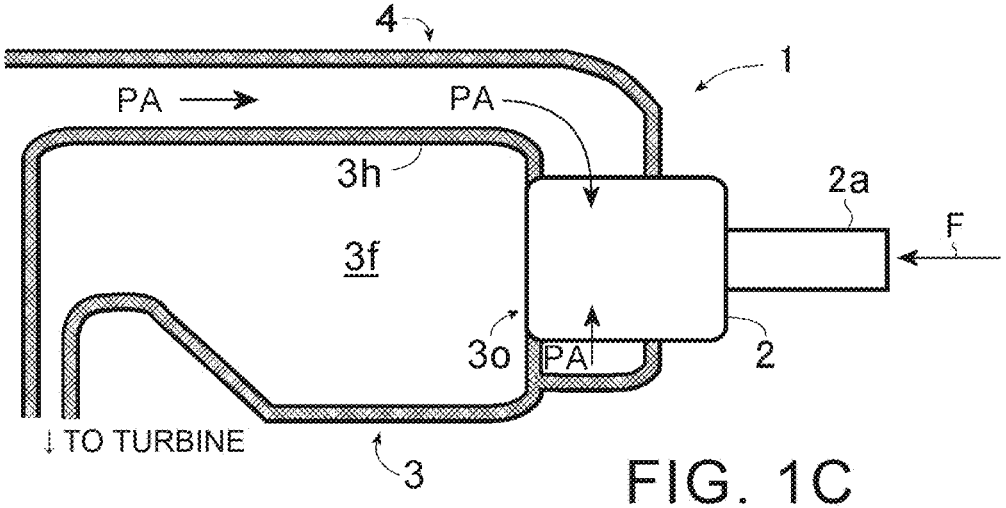
FIG. 1A is a schematic sectional view of a combustor of a gas turbine to which a combustion nozzle according to an embodiment is applied.

A combustion nozzle according to an embodiment is advantageously used in a combustor of a gas turbine fueled by hydrogen or some other substance that is lighter in mass and has a higher combustion temperature than hydrocarbon-based materials that have been used heretofore. As illustrated in FIG. 1A, in a combustor 1 of a gas turbine, a combustion nozzle 2 is installed in an opening portion 3*o* in a housing 3*h* of a combustion chamber 3 that defines a combustion field 3*f*. Briefly, in the combustion nozzle 2, compressed air PA enters from a compressor (omitted from illustration) that is linked to a turbine (omitted from illustration) through a compressed air supply ring 4 that is ring-like and that is defined on an outer circumference of the combustion chamber 3. Also, fuel F flows in from a fuel tank (omitted from illustration), through a fuel supply line 2*a*. These are then mixed and delivered to the combustion field 3*f* for combustion thereof.

Figure 1B:
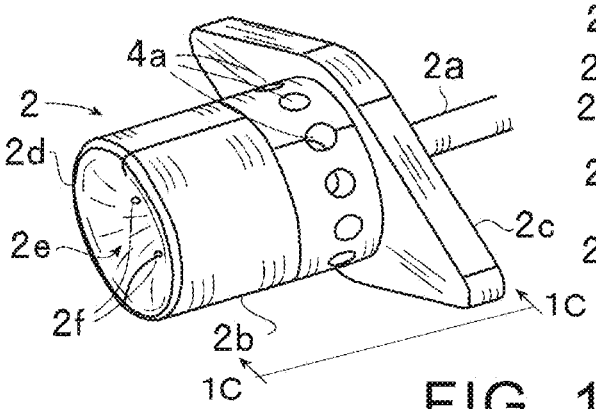
FIG. 1B is a schematic perspective view of the combustion nozzle according to the embodiment.
Figure 1C:
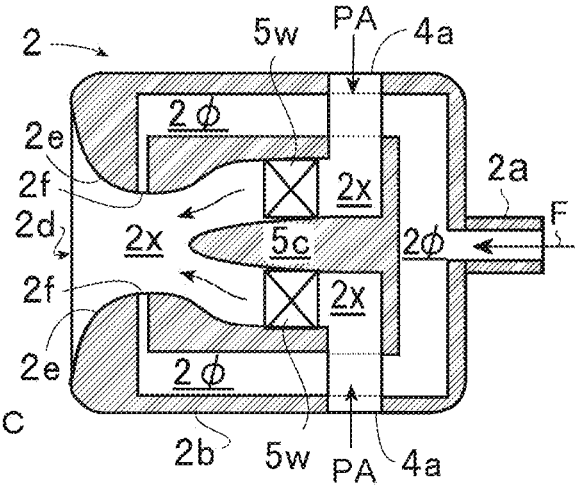
FIG. 1C is a schematic sectional view (taken along line 1C-1C in FIG. 1B) of the combustion nozzle according to the embodiment.
Figure 1D:
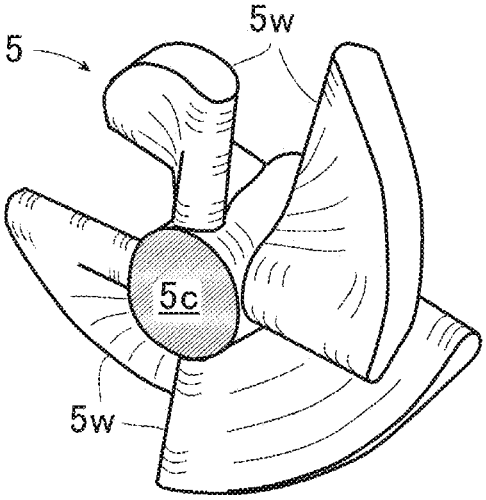
FIG. 1D is a schematic perspective view of a swirler disposed within an air channel of the combustion nozzle of the embodiment.

In the basic configuration of the combustion nozzle 2, as illustrated in FIGS. 1B and 1C, a peripheral wall portion 2*b* that is substantially cylindrical and that extends at a middle portion thereof in an axial direction of the cylindrical shape, and defines an air channel 2*x* opening at a nozzle orifice 2*d* that fits into the opening portion 3*o* of the combustion chamber. The combustion nozzle 2 takes in compressed air PA from air inlets 4*a* formed on an upstream side of the peripheral wall portion 2*b*, and delivers this air to the combustion field 3*f* from the nozzle orifice 2*d*. The cross-section of the air channel 2*x* in a direction perpendicular to a flow direction of the fluid may be substantially circular, but is not limited to thereto. Also, fuel channels 2*p*, through which the fuel F supplied over the fuel supply line 2*a* flows, are formed inside the peripheral wall portion 2*b*, passing through the peripheral wall portion 2*b*, and opening at fuel outlets 2*f* on an inner wall of the peripheral wall portion 2*b*. Fuel is injected toward the flow of compressed air PA flowing in the air channel 2*x*. The fuel outlets 2*f* are typically disposed at a plurality of portions at substantially equidistant intervals along a circumferential direction of the air channels 2*x*. Note that in the peripheral wall portion 2*b*, the fuel channels 2*p* pass through portions where no air flow paths pass, so as not to interfere with the air flow paths from the air inlets 4*a* to the air channels 2*x*. Further, a swirler 5 may be disposed inside the air channel 2*x* defined by the peripheral wall portion 2*b*, as schematically illustrated in FIG. 1D. The swirler 5 has a center cone 5*c* extending along a substantially middle portion of the air channel 2*x*, and a plurality of vane-like members 5*w* extending radially about the center cone 5*c*. The swirler 5 has a shape like that of a screw propeller that does not rotate. In the swirler 5, surfaces of the vane-like members 5*w* are inclined with respect to the center axis of the air channel. Thus, when the flow of compressed air flows along the surface of the vane-like members 5*w*, a direction of flow thereof is rotated, forming a swirling flow.

In particular, in the combustion nozzle 2 according to the present embodiment, a "Venturi section" 2*e*, i.e., a section in which a cross-sectional area of the channel (the cross-sectional area in the direction perpendicular to the flow direction of the fluid in a region in which the fluid can flow) is reduced to be relatively smaller than upstream and downstream of this section, is formed in the air channel 2*x* as illustrated in FIG. 1C. The fuel outlets 2*f* are disposed in this Venturi section 2*e*. Briefly stated, such a configuration increases the flow velocity of compressed air PA when passing through the Venturi section 2*e*, as described in the "SUMMARY". At this point in time, the fuel F is delivered into the flow of compressed air PA. Thus, the fuel F is dispersed in the flow of compressed air PA in a state in which the flow velocity thereof is higher. This enables the fuel to be mixed more uniformly and thoroughly with the compressed air, in a shorter travel distance, than when the fuel is simply merged with the flow of compressed air. Occurrence of areas where the fuel concentration is locally high is suppressed. The flow of compressed air PA in which the fuel F is dispersed, having passed through the Venturi section 2*e*, and flowing out from the nozzle orifice 2*d* to the combustion field 3*f* in the combustion chamber, spreads over a wide space. This reduces overall fuel concentration. Also, the fuel outlets 2*f* are provided at locations where the flow velocity of the compressed air PA increases, to which the fuel F is delivered. This enables backfire into the fuel channels 2*p* to be circumvented, even when the fuel is hydrogen that has a short quenching distance. Thus, according to the configuration of the present embodiment, the fuel is dispersed in the air at the nozzle orifice 2*d* in a more uniform and rarefied manner, while circumventing backfire. This enables the amount of NOx that is generated to be suppressed.

Figure 2:
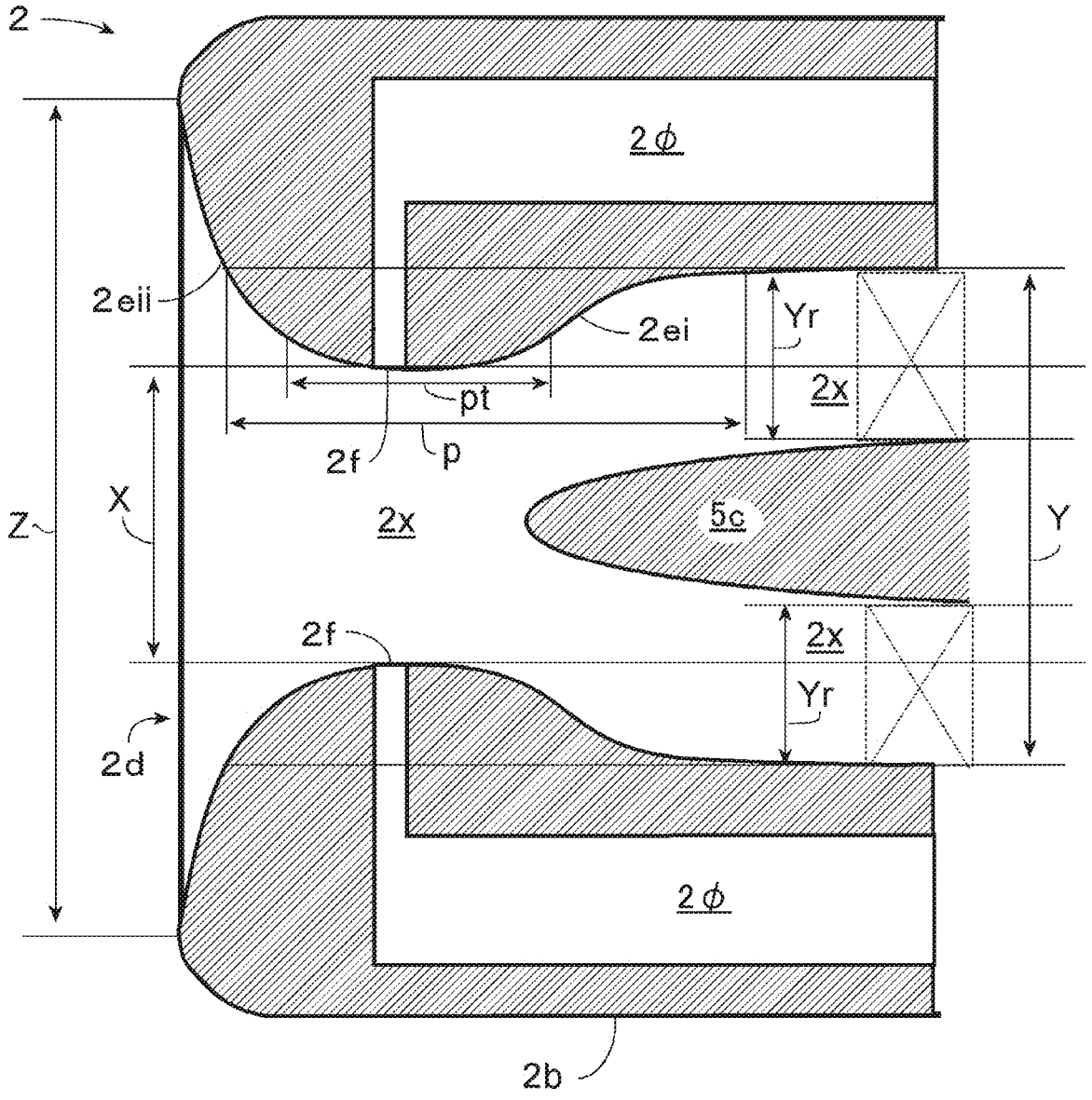
FIG. 2 is a schematic enlarged sectional view of the vicinity of a nozzle orifice and a Venturi section of the combustion nozzle according to the present embodiment.

According to the present embodiment, a ratio of the channel cross-sectional area or an inner diameter ratio of the Venturi section 2*e* as to the regions upstream and downstream of the Venturi section 2*e* in the air channel 2*x*, and the length of the Venturi section 2*e* in the flow direction, may be determined such that the fuel is more uniformly dispersed in the flow of the compressed air PA. With reference to FIG. 2, the dimensions of the Venturi section 2*e* may be set such that the channel cross-sectional area ($\pi X^2/4$) of a portion of the Venturi section 2*e* where the flow channel cross-sectional area is the smallest (smallest diameter X) is significantly smaller than the channel cross-sectional area ($\pi(4YYr-Yr^2)/4$) on the upstream side of the Venturi section 2*e*. Typically, the ratio of the smallest diameter X of the Venturi section 2*e* as to an inner diameter Y of the upstream side of the Venturi section 2*e* may be 40 to 80%. Also, as illustrated herein, the inner diameter and the channel cross-sectional area of the Venturi section 2*e* gradually decrease along the flow direction of the fluid, from the upstream side of the Venturi section 2*e* (first region 2*ei*), and reach the smallest diameter portion. Thereafter, the inner diameter and the channel cross-sectional area gradually increase toward the nozzle orifice 2*d* (second region 2*eii*). Thus, the flow velocity of the flow of compressed air smoothly increases and decreases without stagnation.

The fuel outlets 2*f* provided in the Venturi section 2*e* may be provided at locations at which the flow velocity of the compressed air flow is high. The positions at which the fuel outlets 2*f* are disposed may be determined such that the fuel is more uniformly distributed in the flow of compressed air PA. The fuel outlets 2*f* may be provided in the vicinity of the smallest diameter portion of the Venturi section 2*e*. Specifically, the vicinity of the smallest diameter portion of the Venturi section 2*e* is a section pt upstream and downstream from the smallest diameter portion in FIG. 2. A length pt of this vicinity section may be a section satisfying pt/p≤60% with respect to a length p of the Venturi section 2*e* (length of section in which the inner diameter is smaller than Y).

The hole diameter of the fuel outlet 2*f* is preferably set to be smaller than the quenching distance of the fuel, in order to suppress backfire in which reverse flow of the combusted fluid in the fuel channel occurs. When the fuel is hydrogen, the quenching distance thereof is 0.64 mm. The hole diameter of the fuel outlets may be smaller, such as 0.6 mm or smaller, for example.

Also, when the fuel is a light substance such as hydrogen, the inertial force is small (momentum is weak) when being discharged from the fuel outlets. Simply discharging the fuel from one edge of the air flow would require time for dispersion to take place over the entirety. Accordingly, as illustrated, the fuel outlets may be provided at a plurality of portions substantially equidistantly along the circumferential direction of the flow of compressed air, so that the fuel is more uniformly dispersed in the air flow thereof.

Figure 3A:
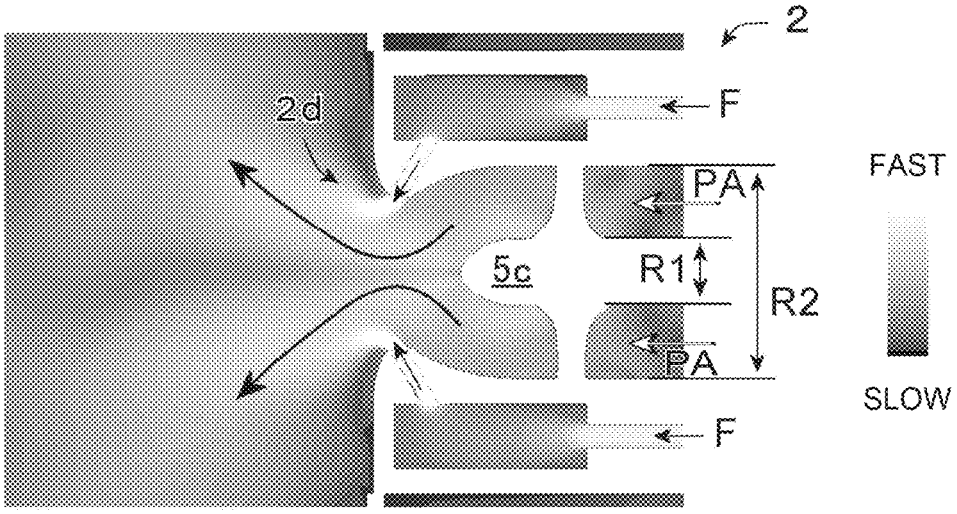
FIG. 3A is a schematic sectional view of the combustion nozzle according to the embodiment, illustrating simulation results of velocity distribution of fluid discharged from the nozzle orifice when a boss ratio (R1/R2) is 0.4, in which flow velocity is represented by intensity of brightness in the illustration.
Figure 3B:
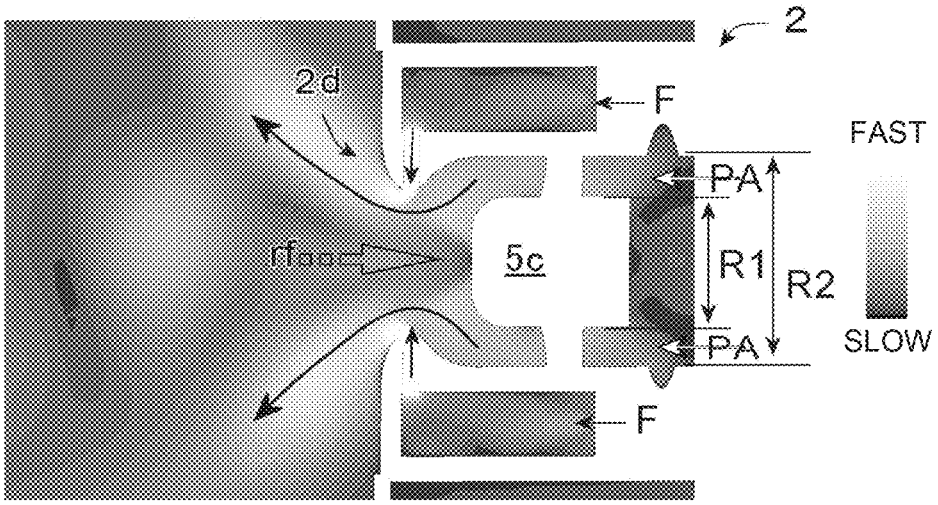
FIG. 3B is a schematic sectional view of the combustion nozzle according to the embodiment, illustrating simulation results of velocity distribution of fluid discharged from the nozzle orifice when the boss ratio exceeds 0.4, in which the flow velocity is represented by intensity of brightness in the illustration.

Furthermore, as described above, providing the swirler 5 that rotates the air flow direction in the air channel 2*x* causes the flow of compressed air to become a swirling flow and pass through the Venturi section 2*e*. The fuel will be more uniformly distributed in the flow of compressed air. In this swirler 5, the center cone 5*c* extends in the substantially middle portion of the air channel 2*x* as described above. With respect to this point, according to research by the inventors of the present embodiment, when the ratio of the cross-sectional area or diameter R1 of the center cone 5*c* as to the channel cross-sectional area or inner diameter R2 of the air channel 2*x* is too large, the flow velocity of the fluid on an extension line of the center cone 5*c* in the nozzle orifice 2*d* is relatively lower than the flow velocity of the surrounding fluid. Thus, heat from the combustion field 3*f* can readily reach a distal end of the center cone 5*c*. As illustrated in FIGS. 3A and 3B, according to simulation carried out by the inventors of the present embodiment, when the ratio R1/R2 (referred to as "boss ratio") of the outer diameter R1 of the center cone 5*c* as to the inner diameter R2 (i.e., Y in FIG. 2) of the air channel 2*x* on the upstream side of the Venturi section 2*e* is less than 0.4, hardly any region is observed in which the flow velocity decreases on the extension line of the center cone 5*c* in the nozzle orifice 2*d*, as illustrated in FIG. 3A. When the boss ratio R1/R2 exceeds 0.4, as illustrated in FIG. 3B, a region is manifested in which the flow velocity decreases on the extension line of the center cone 5*c* in the nozzle orifice 2*d*. Reverse flow rf of the combustion fluid from the combustion field 3*f* to the center cone 5*c* is occurs more readily. Accordingly, in the combustion nozzle according to the present embodiment, the outer diameter of the center cone of the swirler may be designed such that the boss ratio R1/R2 is not excessively great (e.g., 0.4 or less (0.16 or less in terms of cross-sectional area ratio)).

Configuration Example of Combustion Nozzle

Figure 4A:
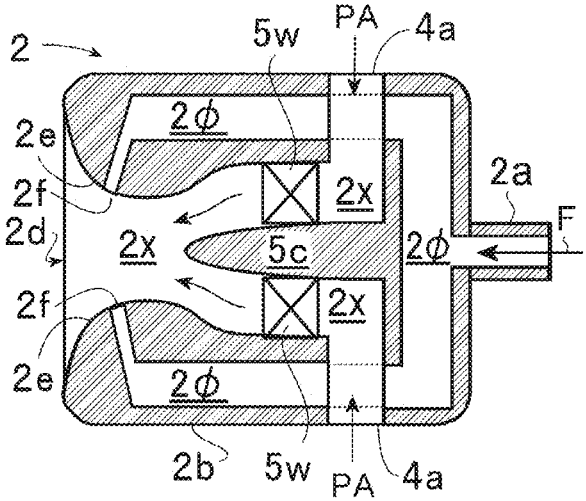
FIG. 4A is a schematic sectional view of a modification of the combustion nozzle according to the embodiment, illustrating an example in which fuel outlets are provided in a region in a channel cross-sectional area of a Venturi section gradually increases toward the nozzle orifice.
Figure 4B:
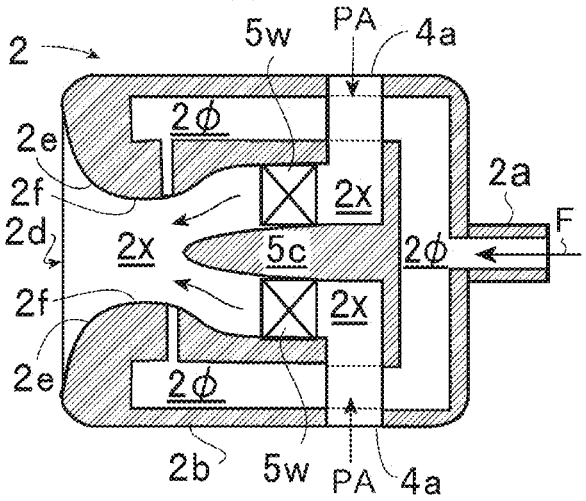
FIG. 4B is a schematic sectional view of a modification of the combustion nozzle according to the embodiment, illustrating an example in which the fuel outlets are provided in the vicinity of a position at which the channel cross-sectional area of the Venturi section is smallest, on an upstream side thereof.
Figure 4C:
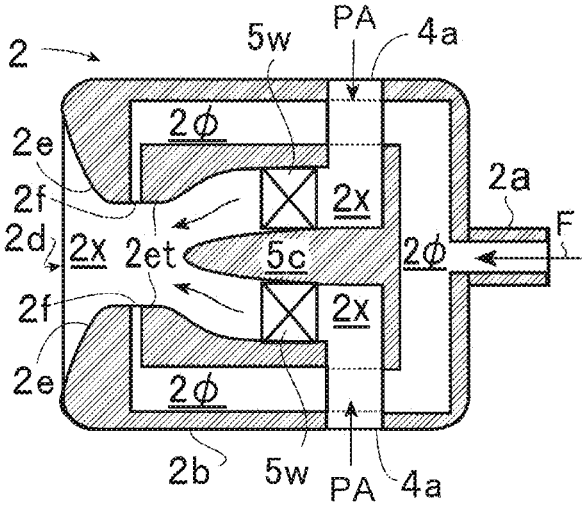
FIG. 4C is a schematic sectional view of a modification of the combustion nozzle according to the embodiment, illustrating an example in which a region where the channel cross-sectional area of the Venturi section is the smallest is formed so as to have a certain level of length in a flow direction of the fluid.
Figure 4D:
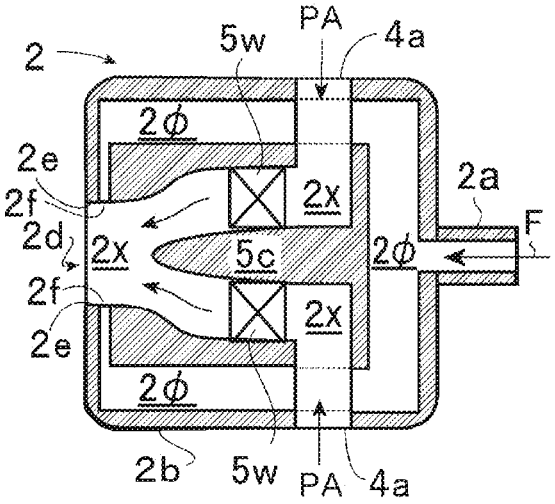
FIG. 4D is a schematic sectional view of a modification of the combustion nozzle according to the embodiment, illustrating an example in which the nozzle orifice is provided without the channel cross-sectional area gradually increasing from the position where the channel cross-sectional area of the Venturi section is the smallest.
Figure 4E:
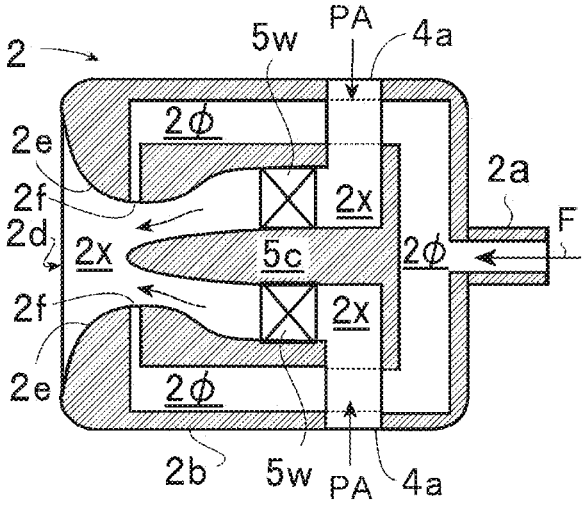
FIG. 4E is a schematic sectional view of a modification of the combustion nozzle according to the embodiment, illustrating an example in which a center cone of the swirler disposed in the air channel protrudes to the position where the channel cross-sectional area of the Venturi section is the smallest.

The specific configuration of the present embodiment may be modified in various ways while satisfying the above preferred requirements. For example, in addition to being opened in a substantially smallest diameter portion of the Venturi section 2*e*, as illustrated in FIG. 1C, the fuel outlets 2*f* may be opened in the second region 2*eii* where the channel cross-sectional area from the smallest diameter portion of the Venturi section 2*e* to the nozzle orifice 2*d* gradually increases, as illustrated in FIG. 4A, as long as the flow velocity of the flow of compressed air is relatively high. Alternatively, as illustrated in FIG. 4B, the fuel outlets 2*f* may be opened in the first region 2*ei* where the channel cross-sectional area gradually decreases in the vicinity of the smallest diameter portion of the Venturi section 2*e*. Also, as illustrated in FIG. 4C, a region 2*et* where the channel cross-sectional area of the Venturi section 2*e* is the smallest may have a certain level of length in the flow direction. Alternatively, as illustrated in FIG. 4D, the nozzle orifice 2*d* may be formed so as to open directly (without forming the second region 2*eii* where the channel cross-sectional area gradually increases) from the smallest diameter portion of the Venturi section 2*e*. Furthermore, as illustrated in FIG. 4E, the center cone 5*c* of the swirler may extend to the smallest diameter portion of the Venturi section 2*e*, to the extent that the degree of fuel dispersion in the mixed fluid discharged from the nozzle orifice 2*d* is not reduced. This increases the flow velocity in the Venturi section. Reverse flow of the fluid from the combustion field 3*f* to the nozzle orifice 2*d* can be made to occur less readily.

Figure 5A:
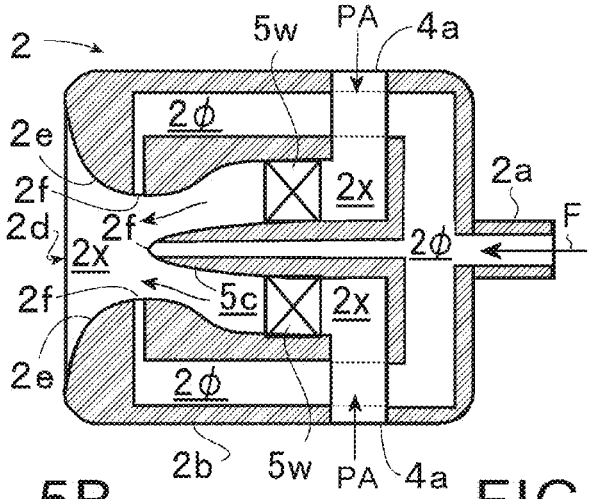
FIG. 5A is a schematic sectional view of a modification of the combustion nozzle according to the embodiment, illustrating an example in which the center cone of the swirler disposed in the air channel protrudes to the position where the channel cross-sectional area of the Venturi section is the smallest, and a fuel channel is formed passing through not only a peripheral wall portion of the nozzle but also through the center cone, so that the fuel is also injected from a distal end of the center cone.
Figure 5B:
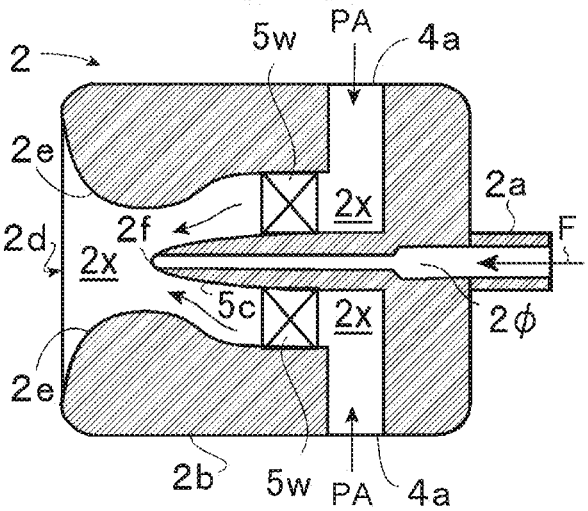
FIG. 5B is a schematic sectional view of a modification of the combustion nozzle according to the embodiment, illustrating an example in which the center cone of the swirler disposed in the air channel protrudes to the position where the channel cross-sectional area of the Venturi section is the smallest, and the fuel channel is formed passing through the center cone, so that the fuel is injected from the distal end of the center cone.
Figure 5C:
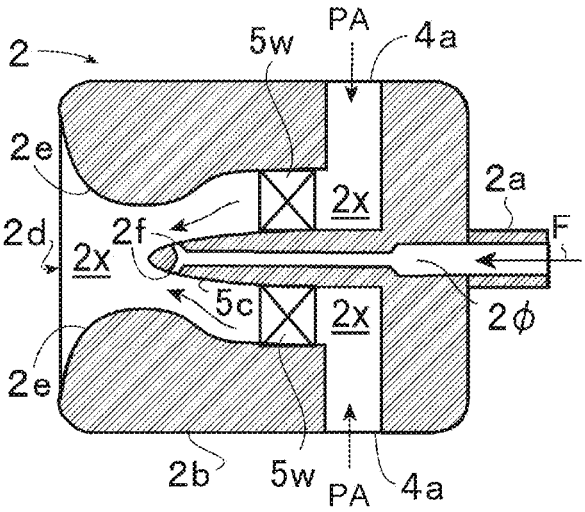
FIG. 5C is a schematic sectional view of a modification of the combustion nozzle according to the embodiment, illustrating an example in which the center cone of the swirler disposed in the air channel protrudes to the position where the channel cross-sectional area of the Venturi section is the smallest, and the fuel channel is formed passing through the center cone, so that the fuel is injected in a circumferential direction from fuel outlets provided in the vicinity of the distal end of the center cone.

Also, when the swirler 5 having the center cone 5*c* is provided in the air channel 2*x*, the center cone 5*c* extends to the Venturi section 2*e* as illustrated in FIG. 5A. One of the fuel channels 2*p* passes through the center cone 5*c*, and one fuel outlet 2*f* is formed at the distal end thereof. Air and fuel is mixed better, thereby reducing the amount of NOx generated. Note that when the center cone 5*c* extends to the Venturi section 2*e* in the air channel 2*x*, the fuel channel 2*p* may be formed only in the center cone 5*c* (with no fuel channels 2*p* formed in the peripheral wall portion 2*b* of the nozzle) and the fuel outlet 2*f* may open at the distal end thereof, as illustrated in FIG. 5B. In this case, formation of the fuel channel 2*p* is facilitated. Note that the fuel outlets 2*f* opened at the distal end of the center cone 5*c* may be opened along an outer circumference of the distal end thereof so as to radially inject the fuel in the vicinity of the distal end of the center cone 5*c*, as illustrated in FIG. 5C.

Figure 6:
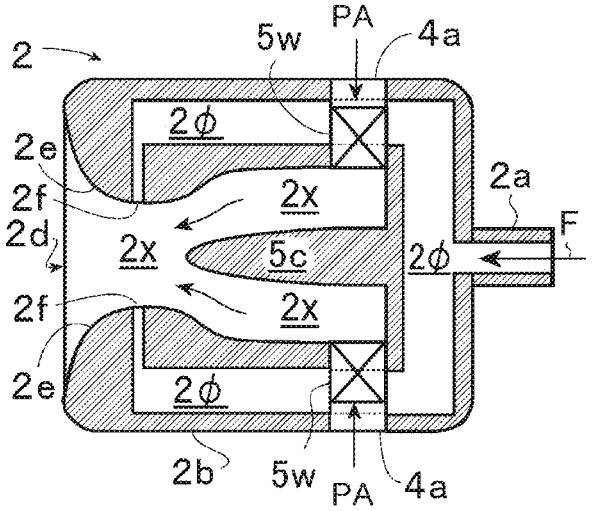
FIG. 6 is a schematic sectional view of a further modification of the combustion nozzle according to the embodiment, illustrating an example in which vane-like members of the swirler disposed in the air channel are provided at air inlets bored in the peripheral wall portion of the nozzle.

Note that the vane-like members 5*w* of the swirler 5 for rotating the direction of the flow of air may be provided at the air inlets 4*a*, as illustrated in FIG. 6. The configuration in which the vane-like members 5*w* are provided at the air inlet 4*a* may also be applied to the configurations illustrated in FIGS. 4A to 5C.

Addition of Air Channels

In the combustion nozzle according to the present embodiment described above, additional air channels may be formed as described below.

Figure 7A:
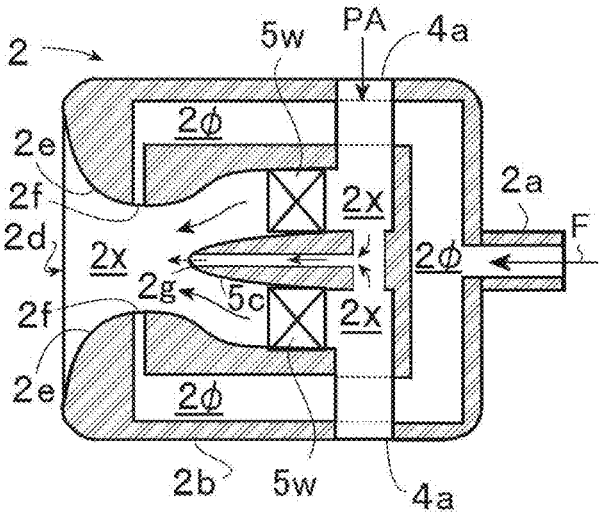
FIG. 7A is a schematic sectional view of a further modification of the combustion nozzle according to the embodiment, illustrating an example in which the air channel is also formed passing through the center cone of the swirler so that air is also discharged from the distal end of the center cone.
Figure 7B:
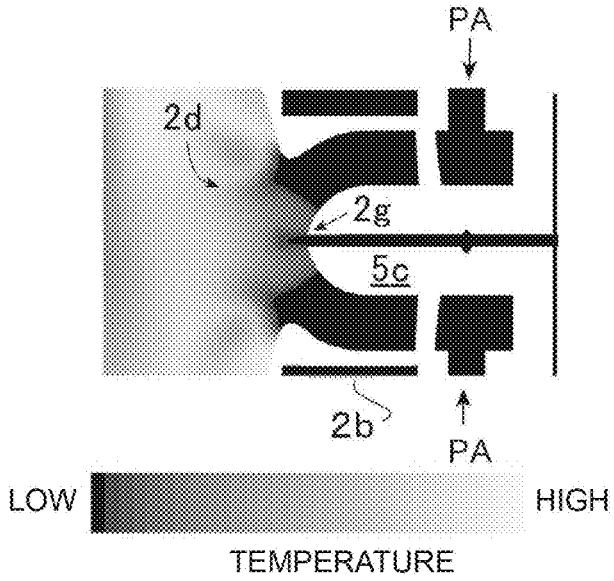
FIG. 7B is a schematic sectional view of the combustion nozzle according to the embodiment, illustrating simulation results of temperature distribution of fluid around the nozzle orifice when the nozzle is formed so that air is also discharged from the distal end of the center cone, in which the height of the temperature is represented by the intensity of brightness.
Figure 7C:
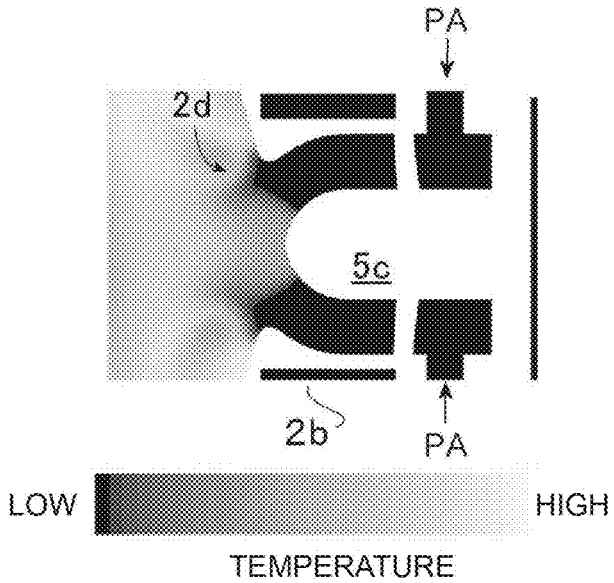
FIG. 7C is a schematic sectional view of the combustion nozzle according to the embodiment, illustrating simulation results of temperature distribution of fluid around the nozzle orifice when air is not discharged from the distal end of the center cone, in which the height of the temperature is represented by the intensity of brightness.

First, as illustrated in FIG. 7A, when the swirler 5 having the center cone 5*c* is provided in the air channel 2*x*, an air channel may further be formed through the center cone 5*c* in the axial direction thereof, and the compressed air may flow out from a distal end (2*g*) of the center cone 5*c*. According to simulation performed by the inventors of the present embodiment, the temperature of the center cone 5*c* becomes relatively high when no compressed air is discharged from the distal end of the center cone 5*c*, as illustrated in FIG. 7C. When compressed air is discharged from the distal end of the center cone 5*c*, the temperature of the center cone 5*c* becomes relatively low, as illustrated in FIG. 7B. Accordingly, in the present embodiment, discharging compressed air from the distal end of the center cone 5*c* as well, as illustrated in FIG. 7A, protects the distal end of the center cone 5*c*, which is readily exposed to high temperatures, from the combustion heat, and the likelihood of melting damage is reduced.

Figure 8A:
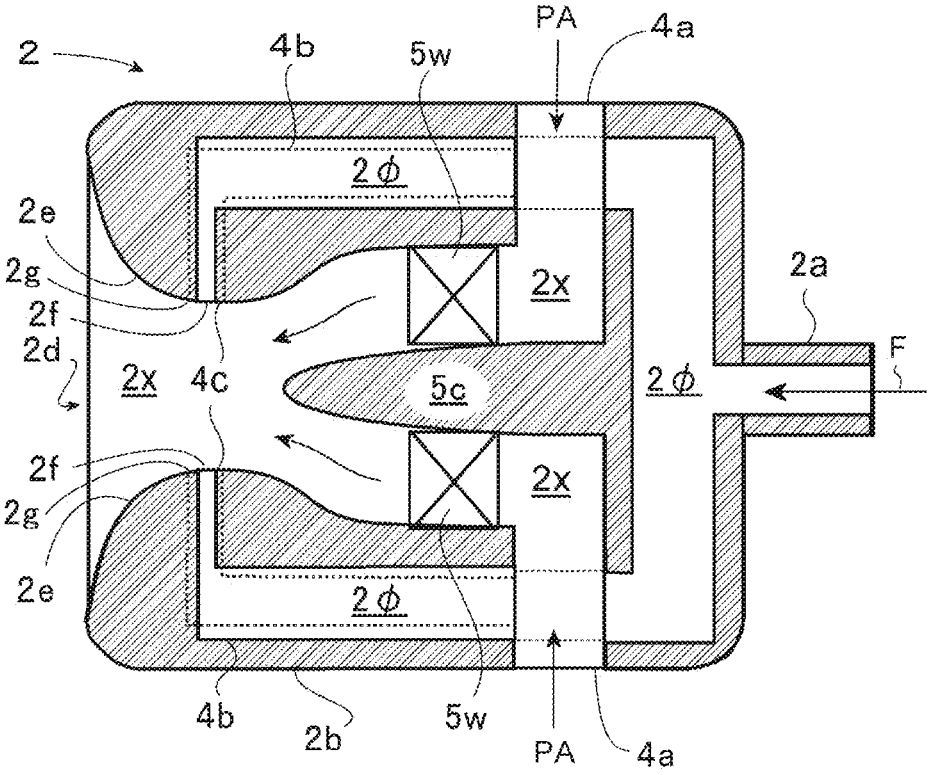
FIG. 8A is a schematic sectional view of a further modification of the combustion nozzle according to the embodiment, illustrating an example in which air channels are formed passing through the nozzle peripheral wall portion as well, such that not only fuel but also air is discharged from the peripheral wall at the Venturi section.
Figure 8B:
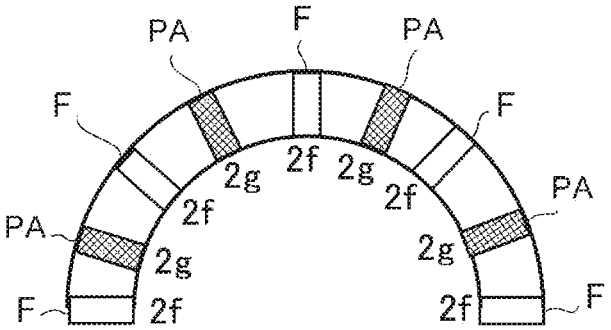
FIG. 8B is a cross-sectional view as viewed from a direction perpendicular to the flow direction of the air channel in the Venturi section in the vicinity of the nozzle orifice, illustrating a layout of fuel outlets and air outlets, representing a case in which the fuel outlets and the air outlets are each alternately laid out along a circumferential direction of the nozzle orifice and extend in substantially radial directions from the center of the nozzle orifice.
Figure 8C:
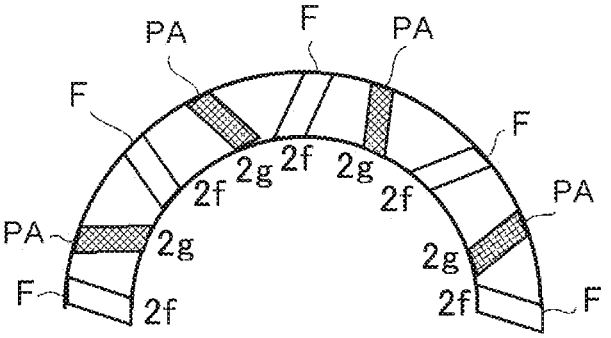
FIG. 8C is a cross-sectional view as viewed from the direction perpendicular to the flow direction of the air channel in the Venturi section in the vicinity of the nozzle orifice, illustrating a layout of the fuel outlets and the air outlets, representing a case in which the fuel outlets and the air outlets are each alternately laid out along the circumferential direction of the nozzle orifice and extend inclined as to radial directions from the center of the nozzle orifice.

Further, as illustrated in FIG. 8A, in the combustion nozzle 2, additional air channels (air channels inside the peripheral wall portion) 4*b* may be passed through the peripheral wall portion 2*b* that defines the air channel 2*x*, in parallel with the fuel passages 2φ. Air outlets 2*g* are provided arrayed along the circumferential direction with respect to the fuel outlets 2*f*. With respect to the flow of compressed air flowing through the air channel 2*x*, air flows are discharged from the air outlets 2*g* that are in the surroundings thereof. With such a configuration, the fuel F discharged from the fuel outlets 2*f* can be expected to be dispersed in the flow of compressed air more uniformly. In this regard, the fuel outlets 2*f* and the air outlets 2*g* in the Venturi section 2*e* may be disposed alternating in the circumferential direction. The orientations thereof may be radially toward the center of the air channel 2*x*, as illustrated in FIG. 8B. Alternatively, the orientations thereof may be optionally inclined with respect to the radial directions towards the center of the air channel 2*x*, as illustrated in FIG. 8C. Accordingly, the fuel flows from the fuel outlets 2*f* collide with the air flows from the air outlets 2*g* in the flow of compressed air in the air channel 2*x*. The fuel and the air are mixed more uniformly.

Figure 9A:
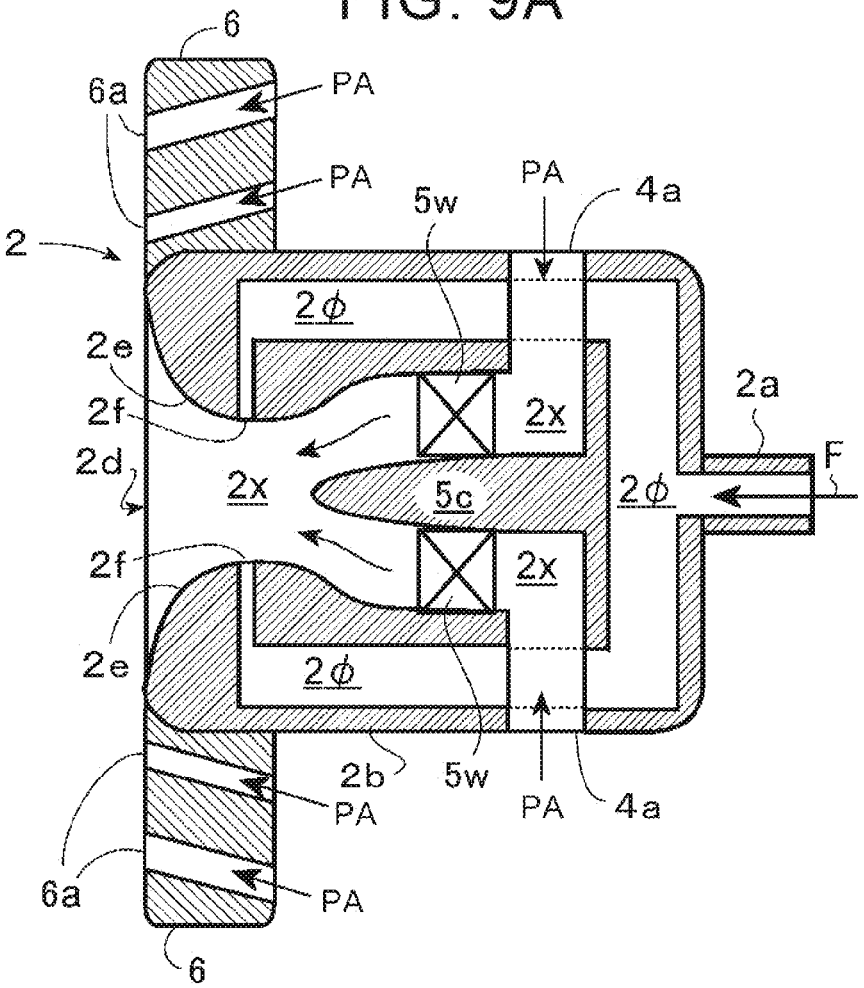
FIG. 9A is a schematic sectional view of a further modification of the combustion nozzle according to the embodiment, which is an example formed such that air is further discharged from an outer circumference of the nozzle orifice.
Figure 9B:
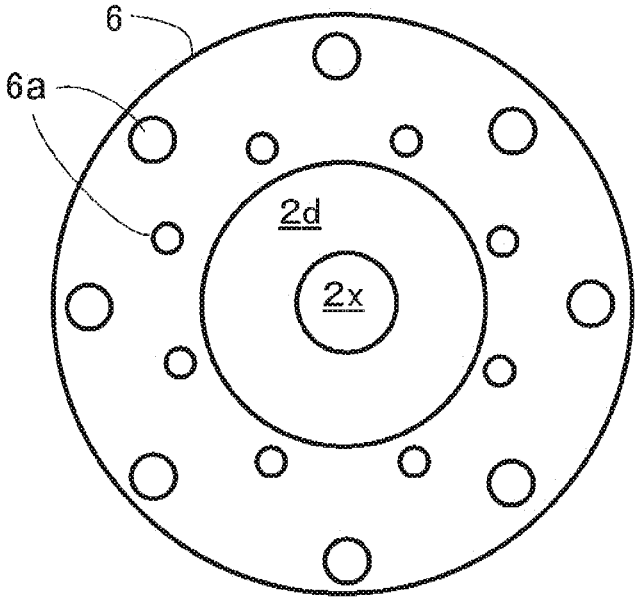
FIG. 9B is a schematic frontal view of an ring member in which discharge holes for discharging air from the outer circumference of the nozzle orifice are laid out (as viewed from a direction perpendicular to the flow of fluid from the nozzle orifice).

As yet another form, in order to discharge compressed air from an outer circumference of the nozzle orifice 2*d* of the combustion nozzle 2 to the combustion field 3*f*, an air discharge ring 6 may be fitted to the outer circumference of the combustion nozzle 2, as illustrated in FIG. 9A, such that the compressed air PA flows out from air discharge holes 6*a* bored in the circumferential direction of the ring 6, as illustrated in FIG. 9B. According to this configuration, the air and the fuel are mixed even more uniformly. The amount of NOx generated is suppressed. A cooling effect on the peripheral wall portion of the nozzle can also be obtained. Such an effect is particularly advantageous when the fuel is hydrogen, due to the high combustion temperature thereof. The air discharge ring 6 is simply a ring provided with through holes, and accordingly can be added at a relatively low cost.

Thus, in the combustion nozzle having the series of constructions described above, the flow of compressed air introduced into the nozzle is temporarily constricted to increase the flow velocity. The fuel is then injected thereto (e.g., from around the air flow). Thus, delivery into the combustion field is performed in a state with a more uniform mixture of air and fuel over a relatively short distance. The air-fuel mixture is combusted in a state of leaner fuel. In the case of combustors or combustion nozzles used in conventional hydrogen gas turbines, the fuel is merged with the flow of compressed air and then carried a long distance before entering the combustion field, in order to mix the air and fuel to the extent that generation of NOx is appropriately controlled. Alternatively, portions where the fuel and air are introduced are subdivided such that flames generated in the combustion field are minute flames, in order to suppress the combustion temperature to a low temperature. Accordingly, the nozzle occupies a large space, due to a large number of fuel supply ports and air supply ports being provided. It has been difficult to downsize the combustion nozzle or combustor. In contrast, according to the configuration of the present embodiment, as described above, the fuel and air are sufficiently uniformly mixed while traveling over a relatively short distance. In the combustion field, areas where the fuel concentration is locally high are suppressed from occurring. Overall fuel concentration is also kept low. The fuel temperature does not become excessively high, locally or overall. Suppression of the amount of NOx generated is achieved. Also, the compressed air flow is constricted before reaching the nozzle orifice and is thus delivered to the combustion field, whereby reverse flow (backfire) of the fluid from the combustion field occurs less readily. Thermal damage (melting damage) of the components of the nozzle is suppressed. According to the configuration of the present embodiment, the combustion nozzle can be made relatively compact, the fuel and air can be uniformly mixed to make the mixture leaner while suppressing backfire, thereby enabling the amount of NOx generated to be suppressed. The combustion nozzle according to the present embodiment can be used particularly advantageously in combustors of small-sized gas turbines that are capable of using hydrogen as fuel.

While the above description has been given with respect to embodiments of the present disclosure, one skilled in the art will be able to easily make many modifications and changes. The present disclosure is not limited to just the embodiments exemplified above, and can be applied to various types of devices without departing from the concept of the present disclosure.

What is claimed is:

1. A combustion nozzle configured to discharge compressed air and fuel, to be combusted, into a combustion chamber of a combustor of a gas turbine, the combustion nozzle comprising:

a single peripheral wall having a cylindrical-shape and having a closed cross-section such that the single peripheral wall defines an upstream end wall portion extending radially inward toward an axis of the combustion nozzle and circumferentially about the axis;

an air inlet provided on the single peripheral wall transverse to the axis;

a nozzle orifice provided at an end of the single peripheral wall and configured to discharge the compressed air into the combustion chamber;

an air channel defined by the single peripheral wall and configured to communicate between the air inlet and the nozzle orifice;

a fuel channel penetrating through the single peripheral wall and extending through the single peripheral wall along the axis; and fuel outlets provided on an inner surface of the single peripheral wall, wherein the fuel channel is configured to discharge the fuel from the fuel outlets toward the axis and toward a flow of the compressed air flowing through the air channel, the air channel includes a Venturi section configured to increase a flow velocity of the compressed air flowing through the Venturi section, the Venturi section includes a first region in which a cross-sectional area of the air channel decreases from an upstream side of the Venturi section along a flow direction of the compressed air, and a second region in which the cross-sectional area of the air channel increases from a downstream end of the first region toward the nozzle orifice, and the fuel outlets are provided in the Venturi section.

2. The combustion nozzle according to claim 1, wherein the fuel outlets are disposed substantially equidistantly along a circumferential direction of the air channel.

3. The combustion nozzle according to claim 1, wherein the fuel outlets open on an inner-side surface of the single peripheral wall in the second region of the Venturi section.

4. The combustion nozzle according to claim 1, wherein the fuel outlets open on an inner-side surface of the single peripheral wall in a vicinity of the downstream end of the first region of the Venturi section.

5. The combustion nozzle according to claim 1, further comprising a swirler that is provided on the upstream side of the Venturi section.

6. The combustion nozzle according to claim 5, wherein:

the swirler includes a center cone disposed along the axis, and a vane-shaped member extending in a radial direction from the center cone and including a surface inclined with respect to the axis; and the compressed air flows along the surface of the vane-shaped member to create a swirling flow.

7. The combustion nozzle according to claim 6, wherein a ratio of an outer diameter of the center cone of the swirler to an inner diameter of the air channel at which the swirler is installed is below a predetermined value.

8. The combustion nozzle according to claim 6, comprising a center-cone-interior channel including a fluid outlet, wherein the center-cone-interior channel passes through the center cone of the swirler along the axis, and the fluid outlet opens at a distal end of the center cone, such that the compressed air is passed through the center-cone-interior channel and the compressed air is discharged from the fluid outlet toward the combustion chamber.

9. The combustion nozzle according to claim 6, wherein:

the center cone of the swirler extends such that a distal end of the center cone extends to a position at a downstream end of the first region.

10. The combustion nozzle according to claim 6, further comprising a center-cone-interior channel including a center-cone fluid outlet, wherein the center-cone-interior channel passes through the center cone of the swirler along the axis, and the center-cone fluid outlet opens at a distal end of the center cone, such that the fuel is passed through the center-cone-interior channel and the fuel is discharged from the center-cone fluid outlet toward the combustion chamber.

11. The combustion nozzle according to claim 1, wherein an inner diameter of each of the fuel outlets is smaller than a quenching distance of the fuel.

12. The combustion nozzle according to claim 11, wherein the quenching distance is 0.64 mm.

13. A combustor of a gas turbine, the combustor comprising a combustion nozzle for discharging compressed air and fuel, to be combusted, into a combustion chamber, wherein:

the combustion nozzle includes a single peripheral wall having a cylindrical-shape and having a closed cross-section such that the single peripheral wall defines an upstream end wall portion extending radially inward toward an axis of the combustion nozzle and circumferentially about the axis, an air inlet provided on the single peripheral wall transverse to the axis, a nozzle orifice provided at an end of the single peripheral wall and configured to discharge the compressed air into the combustion chamber, an air channel defined by the single peripheral wall and configured to communicate between the air inlet and the nozzle orifice, a fuel channel penetrating through the single peripheral wall and extending through the single peripheral wall along the axis, and a fuel outlet provided on an inner surface of the single peripheral wall;

the fuel channel is configured to discharge the fuel from the fuel outlet toward the axis and toward a flow of the compressed air flowing through the air channel;

the air channel includes a Venturi section configured to increase a flow velocity of the compressed air flowing through the Venturi section, the Venturi section includes a first region in which a cross-sectional area of the air channel decreases from an upstream side of the Venturi section along a flow direction of the compressed air, and a second region in which the cross-sectional area of the air channel increases from a downstream end of the first region toward the nozzle orifice; and the fuel outlet is provided in the Venturi section.

14. The combustion nozzle according to claim 1, wherein the Venturi section is configured such that a flow direction of the compressed air flowing through the Venturi section is parallel to the axis.

15. The combustion nozzle according to claim 1, wherein the air channel, at a location where the Venturi section is provided, and the cylindrical-shape of the single peripheral wall are coaxially arranged.

* * * * *